US006064851A

United States Patent [19]

Saitoh

[11] Patent Number: 6,064,851

[45] Date of Patent: May 16, 2000

[54] ELECTROPHOTOGRAPHIC SYSTEM HAVING A SOLVENT REMOVING DEVICE

[75] Inventor: Masato Saitoh, Niigata, Japan

[73] Assignee: NEC Corporation, Tokyo, Japan

[21] Appl. No.: 09/323,399

[22] Filed: Jun. 1, 1999

[30] Foreign Application Priority Data

Jun. 2, 1998 [JP] Japan ..... 10-153028

[51] Int. Cl.[7] ..... G03G 21/00; G03G 15/10

[52] U.S. Cl. ..... 399/348; 399/249

[58] Field of Search ..... 399/237, 249, 399/251, 345, 348, 349, 350, 343, 250

[56] References Cited

U.S. PATENT DOCUMENTS

| | | | |
|---|---|---|---|
| 4,702,591 | 10/1987 | Tsuda et al. | 399/345 |
| 5,521,685 | 5/1996 | Barnes et al. | 399/249 |
| 5,884,128 | 3/1999 | Park | 399/250 |
| 5,937,249 | 8/1999 | Shin | 399/249 |

FOREIGN PATENT DOCUMENTS

| | | |
|---|---|---|
| 56-142565 | 11/1981 | Japan . |
| 48-014876 | 1/1983 | Japan . |
| 61-114258 | 5/1986 | Japan . |
| 3-174177 | 7/1991 | Japan . |
| 3-204656 | 9/1991 | Japan . |
| 56-122072 | 9/1991 | Japan . |
| 4-287081 | 10/1992 | Japan . |
| 5-58192 | 8/1993 | Japan . |
| 8-110707 | 4/1996 | Japan . |

*Primary Examiner*—Susan S. Y. Lee
*Attorney, Agent, or Firm*—Young & Thompson

[57] ABSTRACT

An electrophotographic system includes a photoreceptor belt for carrying a toner image including solvent, a solvent absorbing roller for absorbing the solvent from the toner image, a solvent evaporation roller for receiving the solvent from the solvent absorbing roller and evaporating the solvent therefrom, a cleaning roller for cleaning the solvent absorbing roller, and a cleaning roller for removing the toner on the cleaning roller. The electrophotographic system effectively removes the toner from the solvent evaporation roller without damage of thereof.

4 Claims, 3 Drawing Sheets

ELECTROPHOTOGRAPHIC SYSTEM HAVING A SOLVENT REMOVING DEVICE

BACKGROUND OF THE INVENTION (a) Field of the Invention

The present invention relates to an electrophotographic system having a solvent removing device and, more particularly, to a wet electrophotographic system using a liquid developer including toner particles dispersed in a solvent.

(b) Description of the Related Art

Wet electrophotographic systems using a liquid developer or a wet developing technique have been used for printers or facsimiles. Such a wet developing technique has an advantage of excellent image quality compared to a dry developing technique. The wet developing technique generally uses a solvent removing device for removing solvent from a toner image on a photoreceptor belt after development. The solvent removing device includes a solvent absorbing roller rotatably disposed in contact with the photoreceptor belt. The solvent absorbed by the solvent absorbing roller is further absorbed by a solvent evaporation roller in the solvent removing device for evaporation of the solvent.

In the conventional solvent removing device in the wet electrophotographic system as described above, there is a problem in that a small amount of toner forming the toner image on the photoreceptor belt is also supplied from the photoreceptor belt through the solvent absorbing roller to the solvent evaporation roller and attached thereto. The attached toner is then returned through the solvent absorbing roller to the photoreceptor belt to degrade the quality of the electrophotographic image after being synthesized with the toner image formed on the photoreceptor belt.

The conventional technique for removing the solvent from the solvent evaporation roller uses a brush cleaner provided on the surface of the solvent evaporation roller. However, the brush cleaner has a disadvantage in damaging the surface of the solvent evaporation roller, resulting in a reduction of the ability of the solvent evaporation roller for absorbing the solvent.

SUMMARY OF THE INVENTION

In view of the above, it is an object of the present invention to provide an electrophotographic system having a solvent removing device which is capable of removing the solvent from the surface of the solvent evaporation roller without damaging the surface thereof and reduction in the image quality of the electrophotographic system.

The present invention is directed to an electrophotographic system including a photoreceptor for forming a latent image, a developing device for developing the latent image on the photoreceptor to form a toner image including solvent, a first roller rotatably disposed in contact with the photoreceptor to absorb the solvent from the photoreceptor, a second roller rotatably disposed in contact with the first roller to absorb the solvent from the first roller, and a third roller rotatably disposed in contact with the second roller to remove remaining toner from the second roller. The third roller is preferably provided with a blade for removing the toner from the third roller.

In accordance with the electrophotographic system of the present invention, the remaining toner on the second roller can be removed by the third roller, thereby preventing degradation of the image quality obtained by the electrophotographic system without damage of the second roller.

In the above configuration, it is preferable that the second roller and the third roller be detachably provided, and that the third roller and the blade be detachably provided. The second roller may be a solvent evaporation roller having a heat source for evaporation of the solvent. The blade may be pressed or thrust against the surface of the third roller in the direction opposite to the moving direction of the surface of the third roller.

The above and other objects, features and advantages of the present invention will be more apparent from the following description, referring to the accompanying drawings.

PREFERRED EMBODIMENTS OF THE INVENTION

Figure 1:
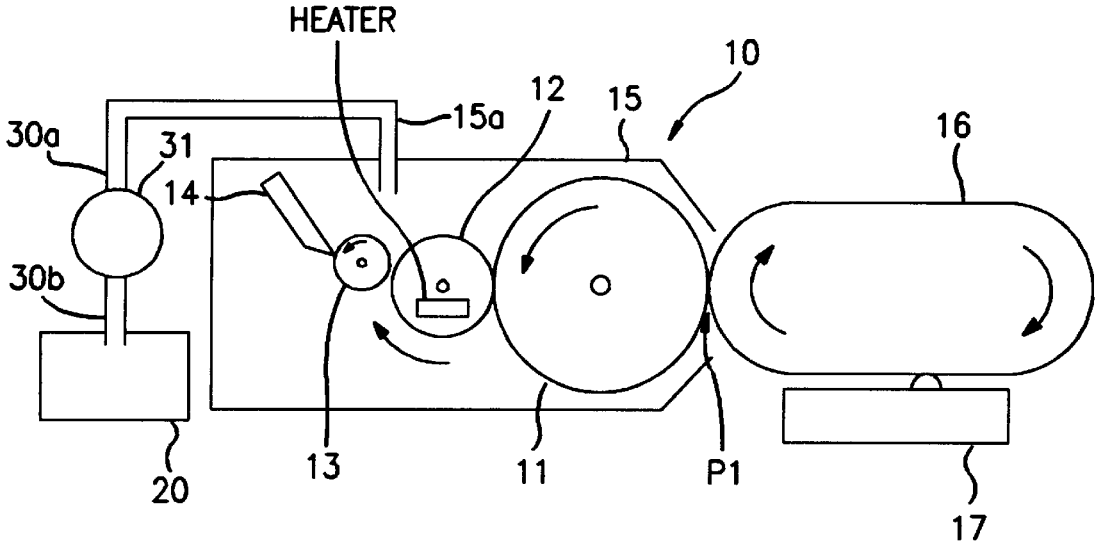
FIG. 1 is a block diagram of an electrophotographic system having a solvent removing device according to a first embodiment of the present invention.

Now, the present invention is more specifically described with reference to accompanying drawings, wherein similar constituent elements are designated by similar reference numerals.

Referring to FIG. 1, an electrophotographic system according to a first embodiment of the present invention includes a photoreceptor belt 16 for moving in the clockwise direction in the drawing while carrying thereon a latent image, a wet developing device 17 for developing the latent image on the photoreceptor belt 16 to obtain a toner image formed by liquid toner including a solvent, and a solvent removing device 10, disposed at the downstream of the wet developing device 17 as viewed in the moving direction of the photoreceptor belt 16, for removing the solvent from the toner image on the photoreceptor belt 16 at the point P1.

The solvent removing device 10 includes a housing 15, and a solvent absorbing roller 11 for rotating in the counter-clockwise direction in the drawing to remove the solvent from the toner image on the photoreceptor belt 16 while contacting therewith at the point P1, a solvent evaporation roller 12 for rotating in the clockwise direction in the drawing to receive the solvent from the solvent absorbing roller 11 while contacting therewith and to evaporate the solvent therefrom, a cleaning roller 13 for rotating in the counter-clockwise direction to remove a small amount of remaining toner from the solvent evaporation roller 12 while contacting therewith, and a cleaning blade 14 having a front edge for cleaning the cleaning roller 13 while contacting therewith, all of which are received in the housing 15.

Each of the solvent absorbing roller 11 and the solvent evaporation roller 12 is covered with a porous sheet having properties such as sponge to absorb the solvent at the surface thereof. The solvent evaporation roller 12 has a heater inside thereof for evaporating the solvent. The rollers 11 to 13 are disposed such that each roller is pressed against the adjacent roller for allowing rotation of the rollers around the respective rotational axis. The cleaning blade 14 is made of an elastic material, and the front edge of the cleaning blade 14 is pressed against the cleaning roller 13 in the direction substantially opposite to the moving direction of the surface of the cleaning roller 13.

The housing 15 has an inlet 15*a* for insertion of an end of a tube 30*a*, the other end of which is coupled to the suction port of an air pump 31. The discharge port of the air pump 31 is coupled to a solvent liquefaction equipment 20 through a tube 30*b*.

In operation, the photoreceptor belt 16, on which a toner image formed of liquid toner including solvent is formed by a wet development technique in the developing device 17, passes the point P1 at which the photoreceptor belt 16 contacts with the solvent absorbing roller 11. Thus, the solvent of the liquid toner in the toner image is absorbed by the solvent absorbing roller 11 at the surface thereof, thereby leaving a dry toner image on the photoreceptor belt 16 for fixation. The absorbed solvent on the solvent absorbing roller 11 is then transferred to the surface of the solvent evaporation roller 12 and subjected to heat by the heater in the solvent evaporation roller 12 for evaporation. The vapor of the solvent is discharged through the tubes 30 and 30*b* by the air pump 14 to the solvent liquefaction equipment 20, where the solvent is again liquefied for reuse thereof.

In the operation as described above, the solvent is collected from the photoreceptor belt 16 to the solvent liquefaction equipment 20. In this process, a minute amount of toner in the toner image is also collected from the photoreceptor belt 16 together with the solvent to the solvent absorbing roller 11, and in turn absorbed to the solvent evaporation roller 12. While the solvent evaporates from the solvent evaporation roller 12, the toner still remains on the surface of the solvent evaporation roller 12 due to the difference in the evaporation temperature between the solvent and the toner.

The remaining toner on the solvent evaporation roller 12 is peeled-off therefrom and attached onto the cleaning roller 13 due to the difference in surface energy between the solvent evaporation roller 12 and the cleaning roller 13. The toner attached onto the cleaning roller 13 is then scratched by the front edge of the cleaning blade 14 to be dropped into a waste toner container, not shown in the drawing, in the housing. Thus, the toner is not returned from the cleaning roller 13 through the solvent evaporation roller 12 and the solvent absorbing roller 11 to the photoreceptor belt 16, and does not degrade the image quality by the electrophotographic system, without causing a damage of the solvent evaporation roller 12.

Figure 2:
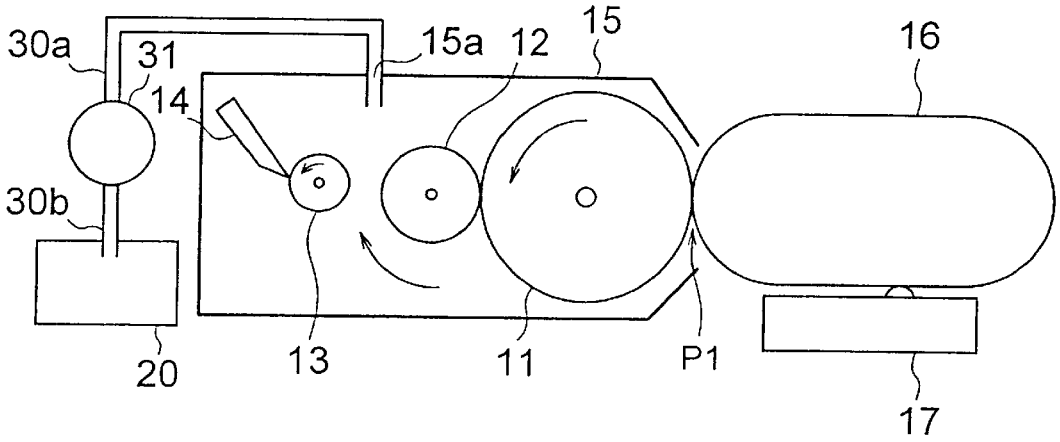
FIG. 2 is a block diagram of an electrophotographic system having a solvent removing device according to a second embodiment of the present invention.
Figure 3:
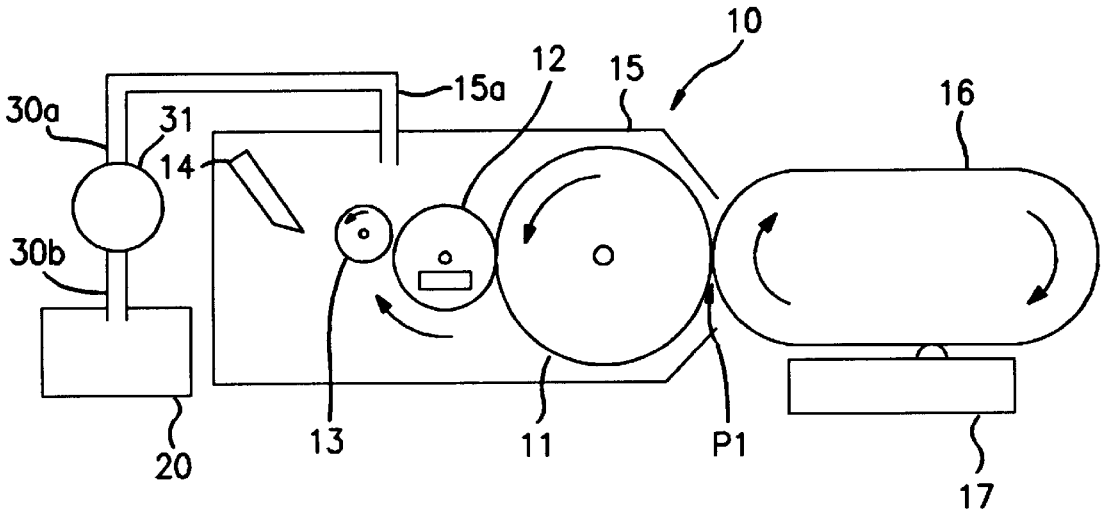
FIG. 3 is a diagram of an electrophotographic system illustrating a detached cleaning blade.

The electrophotographic system according to a second embodiment of the present invention is similar to the first embodiment except that the solvent evaporation roller 12 and the cleaning roller 13 are detachably disposed, as illustrated in FIG. 2, and that the cleaning roller 13 and the cleaning blade 14 are also detachably disposed, as illustrated in FIG. 3.

The toner remaining on the solvent evaporation roller 12 tends to be solidified due to the heat by the heater, which may cause an obstruction against the rotation of the rollers 11, 12 and 13. In the above configuration of the second embodiment, the solidified toner is easily removed from the solvent evaporation roller 12 after detaching the cleaning roller 13 from the solvent evaporation roller 12. The toner remaining on the cleaning roller 13 can be also removed after detaching the cleaning blade 14 from the cleaning roller 13.

Since the above embodiments are described only for examples, the present invention is not limited to the above embodiments and various modifications or alterations can be easily made therefrom by those skilled in the art without departing from the scope of the present invention.

What is claimed is:

1. An electrophotographic system comprising a photoreceptor for forming a latent image thereon, a developing device for developing the latent image on said photoreceptor to obtain a toner image formed by liquid toner including solvent, a first roller rotatably disposed in contact with said photoreceptor to absorb the solvent from the liquid toner on said photoreceptor, a second roller rotatably disposed in contact with said first roller to absorb the solvent from said first roller, a third roller rotatably disposed in contact with said second roller to remove toner from said second roller, and a cleaning blade for removing the toner from said third roller, said cleaning blade being disposed to be in contact with the third roller during operation of the electrophotographic system, wherein said third roller and said cleaning blade are constructed so that the cleaning blade may be detached from the third roller to provide access to the third roller.

2. The electrophotographic system as defined in claim 1, wherein said cleaning blade has a front edge pressed against said third roller in a direction substantially opposite to a moving direction of a surface of said third roller.

3. The electrophotographic system as defined in claim 1, wherein said second roller and said third roller are constructed so that the third roller may be detached from the second roller to provide access to the second roller.

4. The electrophotographic system as defined in claim 1, wherein said second roller comprises a heater for generating heat to evaporate the toner from said second roller.

* * * * *